United States Patent [19]

Ihasz

[11] 3,991,464

[45] Nov. 16, 1976

[54] LATCH AND RELEASE FOR A TRIMMER DEVICE IN AN ELECTRIC DRY SHAVER

[75] Inventor: Richard Ihasz, Milford, Conn.

[73] Assignee: Sperry Rand Corporation, Bridgeport, Conn.

[22] Filed: June 4, 1975

[21] Appl. No.: 583,615

[52] U.S. Cl. ..... 30/34.1

[51] Int. Cl.[2] ..... B26B 19/10

[58] Field of Search..... 30/34.1, 43.91, 43.92, 30/90, 42

[56] References Cited

UNITED STATES PATENTS

| | | | |
|---|---|---|---|
| 3,714,710 | 2/1973 | Daniels | 30/34.1 |
| 3,874,079 | 4/1975 | Waters | 30/34.1 |
| 3,909,938 | 10/1975 | Brenneman | 30/34.1 |
| 3,911,572 | 10/1975 | Czerner | 30/34.1 |

*Primary Examiner*—Gary L. Smith
*Attorney, Agent, or Firm*—Charles R. Miranda

[57] ABSTRACT

A trimmer device for an electric dry shaver is disclosed having a trimmer cutter assembly which is mounted for rotation between operative and inoperative positions on the shaver. The trimmer cutter is biased to an operative position. A latch and release for securing the assembly in an inoperative position and for releasing the assembly to an operative position comprises a resilient latch body and a cantilever support for the latch body which positions the latch body in a path of travel of the rotatable assembly. A catch is provided for effecting and maintaining engagement between the latch body and the assembly and for effecting disengagement upon tactile actuation thereof.

11 Claims, 8 Drawing Figures

Fig. 4.
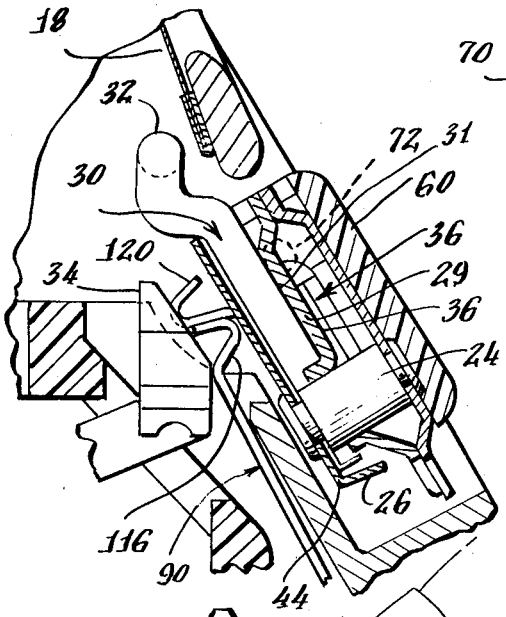
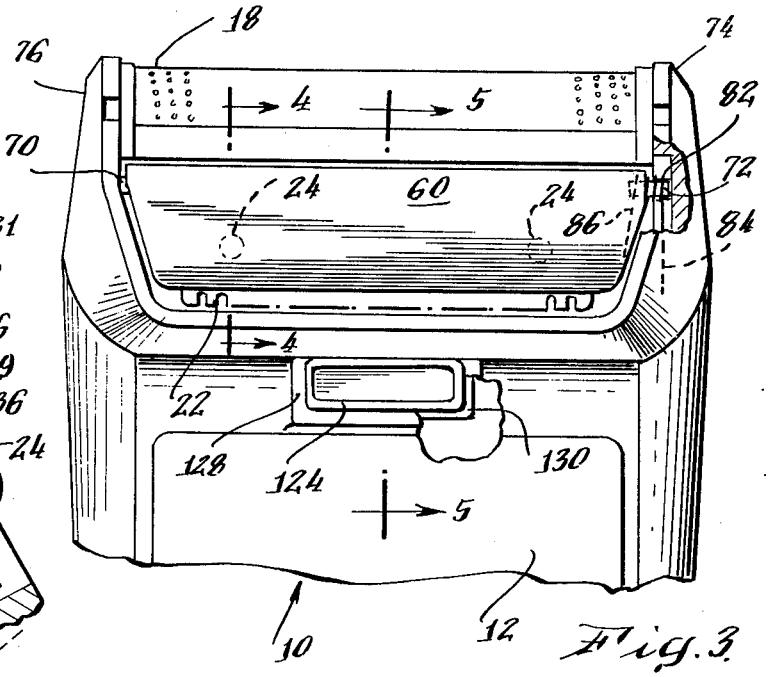
Fig. 3.
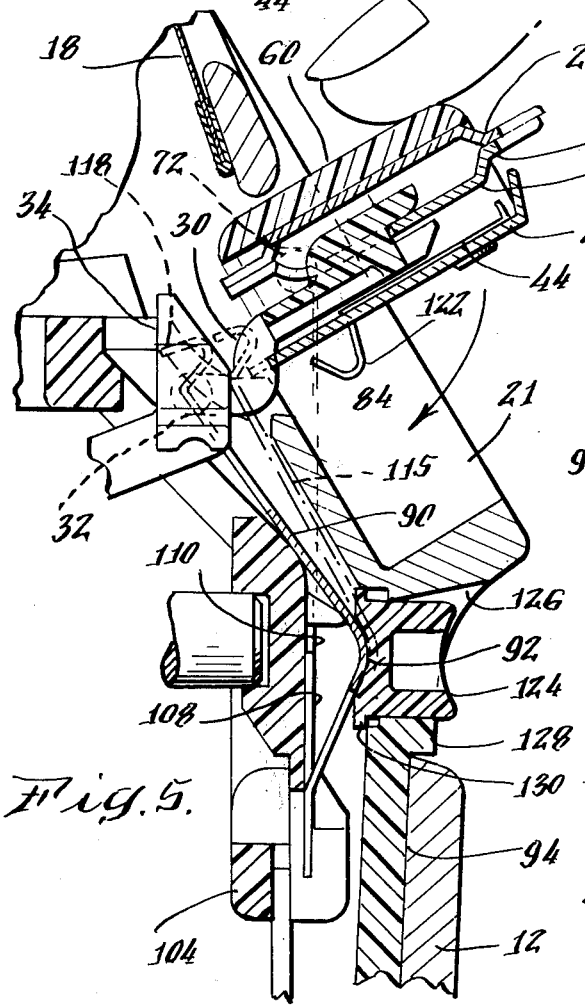
Fig. 5.
Fig. 6.
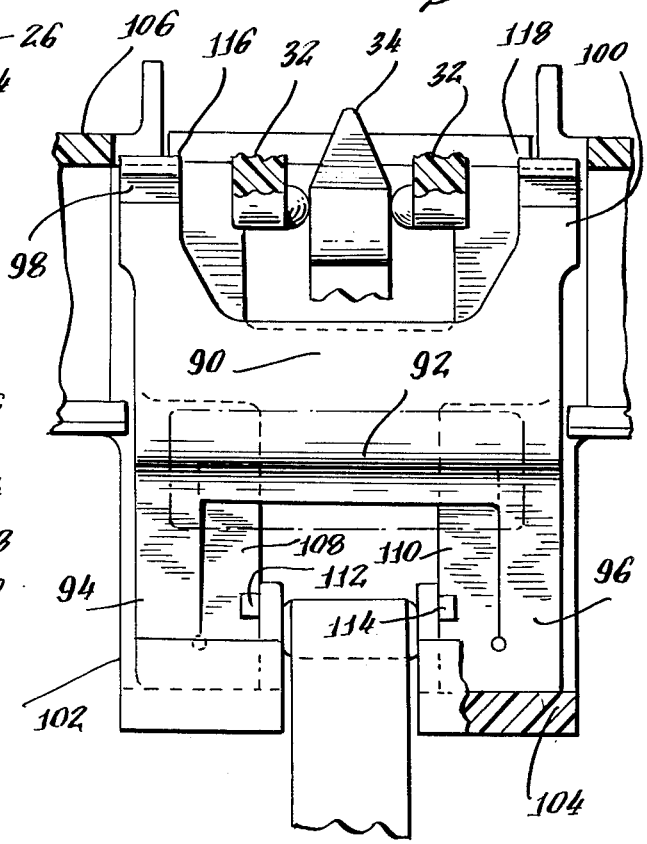

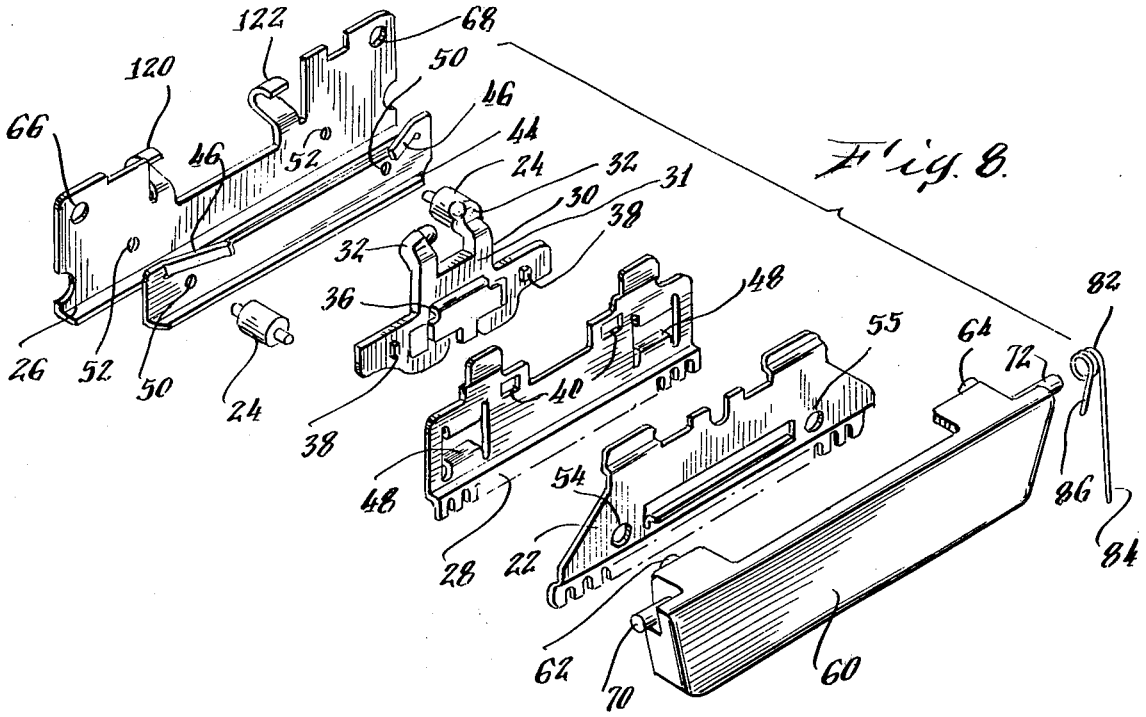
Fig. 8.
Fig. 7.
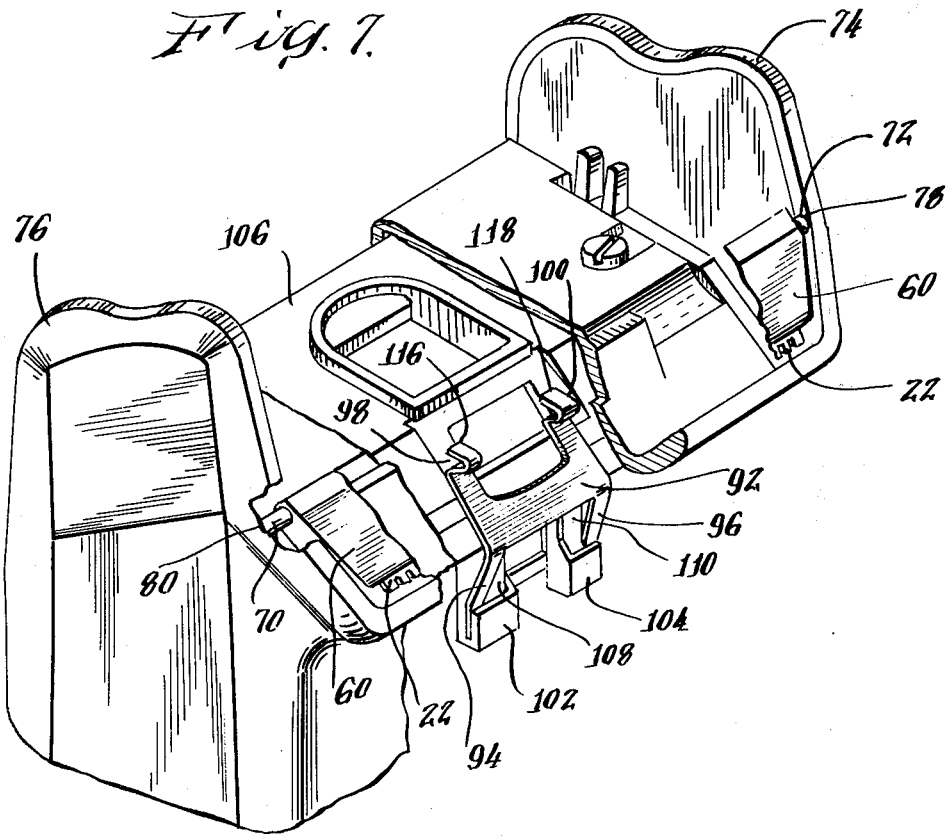

LATCH AND RELEASE FOR A TRIMMER DEVICE IN AN ELECTRIC DRY SHAVER

BACKGROUND OF THE INVENTION

This invention relates to new and useful impovements in electric dry shavers and more particularly to an improved latch and release arrangement for an auxiliary trimmer device in a dry shaver.

Trimmer devices have been used as auxiliary cutter units in electric dry shavers and are most frequently employed to trim sideburns and moustaches. The trimmer device generally includes an assembly of a stationary comb member, a movable, toothed, cutter member which is reciprocated adjacent the comb member for cutting hairs fed into its moving path and a means for actuating the cutter member. This assembly is supported in a rotatably mounted housing on the electric dry shaver and is generally flush with the surface of the shaver when the trimmer device is inoperative but is rotatable into an operative position for use.

A variety of mechanisms have been provided for latching the trimmer device in an inoperative position and for releasing it to an operative position. These mechanisms usually include actuating release means which require a relatively complex placement of parts on the shaver casing resulting in difficult and cumbersome assembly procedures, an increase in the overall manufacturing cost and maintenance of the shaver and a decrease in the reliability of the trimmer unit.

Accordingly, it is an object of this invention to provide an improved trimmer device for an electric dry shaver.

Another object is to provide an improved means for latching a trimmer device in an inoperative position and for releasing it to an operative position.

Another object is to provide a latch and release means for a trimmer device which is relatively compact, readily assembled, reliable, utilizes a relatively small number of parts, and permits relatively large manufacturing tolerances.

SUMMARY OF THE INVENTION

In accordance with the features of this invention, a trimmer device for an electric dry shaver having a main cutter head supported on a casing comprises a trimmer cutter assembly which is mounted for rotatable movement between inoperative and operative positions on the shaver. Means are provided for biasing the assembly to an operative position. A latch and release arrangement for the trimmer assembly includes a resilient latch body and means for providing a cantilever support for the latch body. The resilient latch body is supported in a home position which is located in the path of travel of the rotatable assembly. A catch means is provided for effecting and maintaining engagement between the latch body and the assembly after deflection of the latch body by the assembly. A release actuating means is positioned for deflecting the latch body in order to disengage the catch means thereby enabling the release of the assembly to the biased operative position.

These and other objects and features of the invention will become apparent with reference to the following specification and to the drawings wherein one embodiment of the invention is illustrated.

DESCRIPTION OF THE DRAWINGS

FIG. 3 is a partial front elevation view of the shaver of FIG. 1;

FIG. 4 is a fragmentary portion of a view taken along lines 4—4 of FIG. 3 and illustrating a trimmer device latched in an inoperative position;

FIG. 5 is a fragmentary portion of a view taken along lines 5—5 of FIG. 3 and illustrating a trimmer device in an operative position;

FIG. 6 is an enlarged, fragmentary, partially cut away, front elevation view illustrating a latch body constructed in accordance with features of one embodiment of this invention;

FIG. 7 is a perspective view of a portion of the main cutter head of an electric dry shaver illustrating a means for mounting the resilient latch body in accordance with one embodiment of this invention; and FIG. 8 is an exploded view of a trimmer cutter assembly and housing therefor.

DETAILED DESCRIPTION

Figure 1:
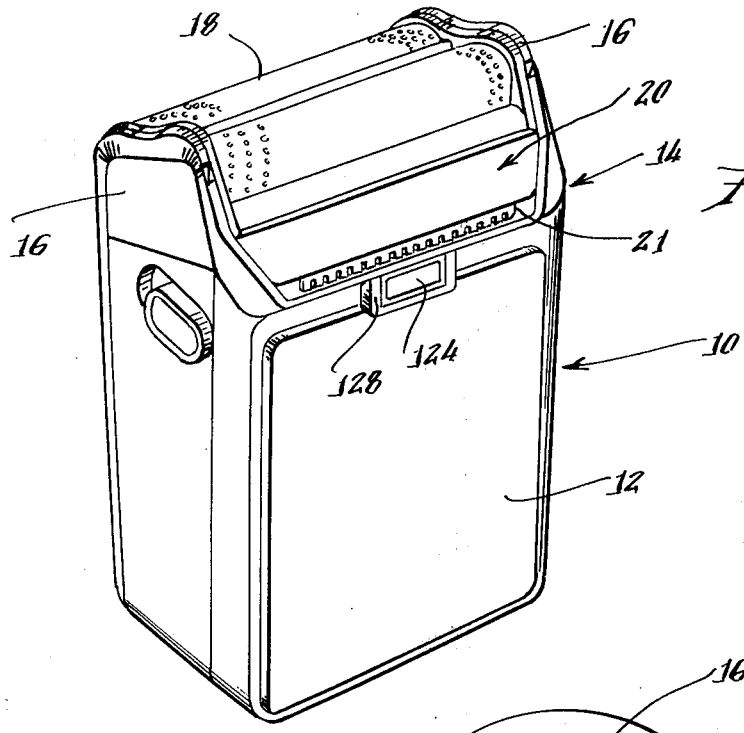
FIG. 1 is a perspective view of an electric dry shaver constructed in accordance with features of one embodiment of this invention.

Referring now to the drawings for a more detailed description of the present invention, an electric dry shaver which incorporates one embodiment thereof is generally indicated by reference numeral 10 in FIG. 1. The shaver 10 is of a known general construction in that it includes a main casing section 12, and upper cutter head supporting section 14 in which is supported a main cutter head assembly generally indicated by the reference numeral 16. The cutter head assembly 16 is of the known general foil type and includes an outer cutter 18 and a plurality of inner cutter blades (not illustrated) which are coupled and actuated by an electric motor 19 positioned in the lower portion of the casing 12.

A trimmer device constructed in accordance with features of the present invention is generally indicated in FIG. 1 by reference numeral 20. Trimmer device 20 is positioned beneath main cutter head 16 within a cavity portion 21 which is provided in one face of an upper portion of the casing 12 and it is generally flush with the casing in an inoperative position.

The trimmer device includes a trimmer cutter assembly indicated generally by reference numeral 23. As illustrated in FIG. 4 and Fig. 5, the trimmer cutter assembly 23 includes a stationary toothed comb 22 which is mounted by studs 24 to a support plate 26. A toothed movable cutter 28 is positioned adjacent the stationary comb 22 and is reciprocated adjacent to comb 22 for cutting hairs which are fed into its moving path. The movable cutter 28 is oscillated by an actuating member 30 having a fork segment 32 (FIG. 6) which engages a trimmer cutter drive shaft 34 when the assembly is positioned in an operative position as illustrated in FIG. 5 and FIG. 6. The drive shaft 34 is mechanically coupled to the electric motor 19, and is reciprocated from left to right as viewed in FIG. 6 when the motor is energized. Decoupling of the trimmer cutter assembly from the drive shaft 34 is provided when the assembly is rotated to its inoperative position as illustrated in FIG. 4. The movable cutter 28 is rigidly secured to the actuating member 30 by sandwiching a surface segment 29 of the cutter 28 between a flat surface 31 of the member 30 and a flange segment 36. Tabs 38, (FIG. 8) which are integrally formed in the member 30 and which extend into apertures 40 of the movable cutter provide for alignment between the cutter teeth and the actuator member 30. A spring plate 44 is provided and is positioned between the support plate 26 and the actuating member 30. Spring tabs 46 which are integrally formed in this plate are provided for biasing the movable cutter against the surface of the stationary cutter. The studs 24 which secure the stationary cutter 22 to the support plate 26 extend through windows 48 which are formed in the movable cutter 28. Narrow bore segments of the studs extend through aligned apertures 50 and 52 of the spring plate 44 and support plate 26 respectively. Narrow bores on opposite ends of the studs 24 extend through apertures 54 and 55 in the stationary cutter 22 and are peened over for rigidly securing this cutter to the plate 26. The assembly of the cutter 28 and the actuating member 30 can be actuated in reciprocating motion with respect to the stationary cutter 22, when the member 30 is actuated.

A means for mounting the trimmer cutter assembly for rotatable movement between the inoperative and operative positions on the shaver includes a trimmer device housing 60 which, with the support plate 26, encloses the stationary and removable cutters, the spring plate 44 and portions of the actuator 30. The support plate 26 is secured to the housing member 60 by studs 62 and 64 which, as shown in FIG. 8, align with and extend through apertures 66 and 68 respectively of the support plate 26 and which are peened over for mounting the plate to housing 60. A pivotal means for rotatably supporting the housing 60 is provided by trunnion segments 70 and 72 which are integrally formed with the housing 60. As illustrated in FIG. 7, the shaver head includes wall segments 74 and 76 having bearing means 78 and 80 for receiving the trunnions 72 and 70 respectively and for providing a rotatable mounting for the trimmer cutter assembly.

A means for biasing the trimmer cutter assembly in the operative position wherein the cutter teeth extend away from the shaver body generally as illustrated in FIG. 5 is provided. These means comprise a torsion spring 82 having a coil which is positioned about the trunnion 72. An elongated segment 84 of the torsion spring bears against an inner wall segment of the wall 74 while a second relatively shorter segment 86 engages an inner surface of the housing 60 thereby biasing the assembly to an operative position.

A resilient latch body is provided and comprises a leaf spring 90 which is formed of spring steel. As illustrated in FIGS. 6 and 7, the leaf spring 90 includes a bend 92 extending across its width and which is formed at an intermediate position along its length. The leaf spring 90 includes spaced apart support legs 94 and 96 located at one end thereof and a pair of spaced apart legs 98 and 100 located at an opposite end of the spring. The spring thus has a generally bow-shaped, H configuration.

A cantilever support means for the latch body 90 is provided by a pair of pockets 102, 104 which are integral with and depend from a plastic motor shroud member 106. The pockets receive the lower segments of the legs 94 and 96 of the leaf spring latch body 90. It will be noted that the lower legs 94, 96 each include split tab segments 108 and 110 respectively. These tab segments have teeth 112 and 114 respectively which engage side segments of the pockets 102 and 104 and which inhibit the removal of the latch body from the pockets.

Figure 2:
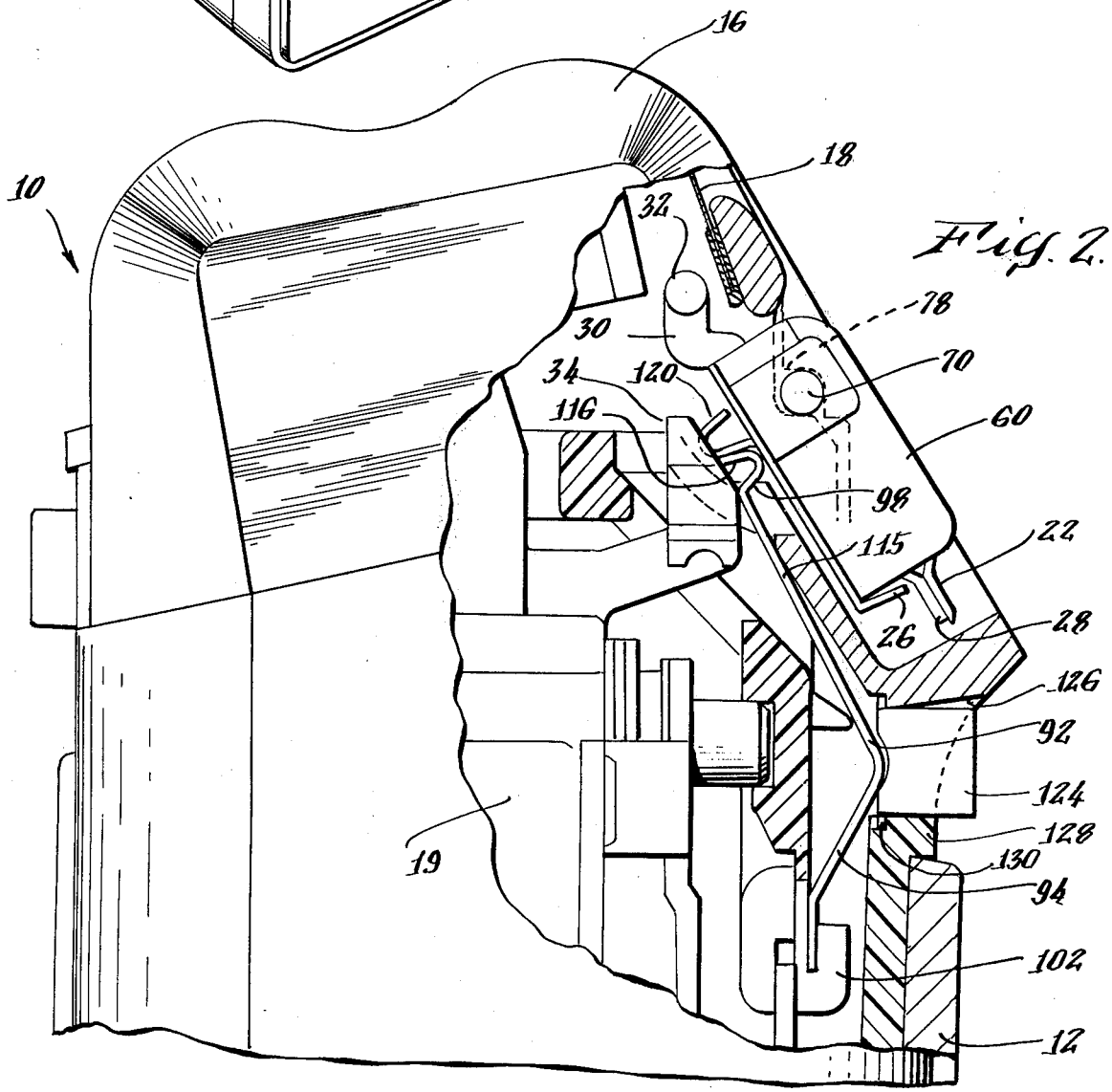
FIG. 2 is an enlarged side elevation view, partly cut away, illustrating a trimmer device latch and release means.

The leaf spring latch body 90 which is supported at one end thereof is positioned in a generally central location with respect to the elongated housing 60 of the trimmer cutter device and is positioned in the path of travel of the rotatable trimmer cutter assembly. The latch body 90 has a mounted, undeflected home position 115 as illustrated in FIGS. 2 and 5. When the trimmer cutter assembly is rotated in a clockwise direction to its inoperative position as illustrated in FIG. 5, the latch body 90 is deflected from its home position toward the main cutter head by contact with the rotating trimmer assembly.

A catch means is provided and maintains engagement between the latch body 90 and the trimmer cutter assembly. The catch means comprises U-shaped projections 116 and 118 which are located at distal portions of the spaced apart leg segments 98 and 100 of the latch body 90. The catch means further includes U-shaped projections 120 and 122 which extend from a lower surface of the cutter assembly support plate 26 and which are aligned with the projections 116 and 118 of the latch body. As best seen in FIG. 5, the trimmer cutter assembly is rotated by the application of finger pressure in a clockwise direction into the cavity 21. The projections 120 and 122 on plate 26 contact the projections 116 and 118 causing the latch body 90 to deflect from its home position toward the main cutter head. In addition during this deflection, the latch body projections 116 and 118 rotate in a counterclockwise direction about an axis located at or near the bend 92 and allow the projections 120 and 122 to slide over the top segments of the projections 116 and 118 and nestle on an opposite side thereof to provide contact and engagement between projection surfaces. As the cutter trimmer assembly is rotated fully clockwise in the cavity 21, the projections engage as indicated and the latch body 90 returns to its home position while engagement of the surfaces of the catch projections is maintained. A positive detenting engagement is thus provided between the latch body 90 and the trimmer cutter assembly which secures the assembly in the inoperative position.

A release actuating means is provided and is positioned for deflecting the latch body in order to cause disengagement of the catch means and to release the trimmer cutter assembly for rotation by the biasing means 82 toward an operative position. The release means comprises a latch body contact member 124 which is shown to comprise a plastic body located in an aperture 126 of a wall segment 128 of the casing 12. The contact member 124 includes an integrally formed shoulder segment 130 which captivates the push button within the aperture adjacent to the bend 92 in the latch body. As illustrated in FIG. 5, release of the cutter trimmer assembly to an operative position is effected by depressing the push button 124 which causes movement of the latch body from its home position and results in disengagement of the catch means projections. Since the restraining influence for the cutter trimmer in the cavity 21 is thereby removed, the cutter trimmer yields to the bias force of the torsion spring 82 and rotates in a counterclockwise direction to the operative position.

An improved trimmer device for an electric dry shaver has thus been described which includes an improved latch and release means of advantageous construction. The described latch and release means enhances the reliability of operation, reduces the complexity of the structure and the complexity in placements of parts during assembly and reduces the overall cost of the trimmer unit.

While I have described a particular embodiment of my invention, it will be appreciated by those skilled in the art that variations may be made thereto without departing from the spirit of the invention and the scope of the appended claims.

I claim:

1. An improved trimmer device for an electric dry shaver having a main cutter head supported on a casing comprising:

a. a trimmer cutter assembly;

b. means for mounting said assembly for rotatable movement of said assembly between inoperative and operative positions on said shaver;

c. means for biasing said assembly to an operative position;

d. a resilient latch body;

e. means providing cantilever support for said body, said body having an undeflected home position located in a path of travel of said rotatable assembly whereby said body is deflected from said home position by said trimmer assembly when said trimmer assembly is rotated to said inoperative position;

f. catch means for providing a detented engagement between said body and said assembly to maintain the latter in its inoperative position; and g. release actuating means contacting the latch body and operable for deflecting the body for disengaging said catch means whereby the assembly is released to said biased operative position.

2. The trimmer device of claim 1 wherein said catch means includes an integrally formed segment of said resilient latch body and is shaped to engage a member of said trimmer cutter assembly.

3. The trimmer device of claim 1 wherein said resilient latch body comprises a metal leaf spring which is supported near an end thereof.

4. The trimmer device of claim 3 wherein said catch means comprises a projection integrally formed in said leaf spring body, a projection formed in a surface of said trimmercutter assembly and which is adpated for engaging said leaf spring projection upon deflection of said latch body from said home position and for maintaining engagement upon relaxation of said deflected body to said home position.

5. The trimmer device of claim 4 wherein said resilient body has a length and width, said body is bent along its width at an intermediate position along its length to form a generally bow shaped configuration and a distal unsupported end of said body is deflectable through an arc having a center of radius located at said bend.

6. The trimmer device of claim 5 wherein the shaver casing includes a wall member thereof positioned adjacent the bend of said resilient body, an aperture formed in said wall member adjacent said bend and an actuating member positioned in said aperture and adapted for contacting and deflecting said resilient body upon the application of a tactile force to said actuating member.

7. The device of claim 4 wherein said leaf spring projection is formed at said unsupported distal end of said body.

8. The trimmer device of claim 7 wherein said resilient body includes first and second spaced apart leg segments formed at one end of said resilient body and which are supported on said shaver, a pair of leg segments formed in an opposite end of said body, said leaf spring projection is integrally formed in each of said latter leg segments at distal portions thereof, and said assembly includes a plate, said trimmer cutter projection comprises a pair of projections positioned on said plate for contacting and deflecting said body and for engaging the projections of said resilient body.

9. The trimmer device of claim 8 wherein said means for mounting said trimmer cutter assembly include an elongated housing for the assembly, pivot means for mounting said housing to the shaver for rotatable movement thereof, and said resilient latch body is supported at a generally central location with respect to said housing.

10. The trimmer device of claim 9 wherein said shaver includes a shroud member having means for supporting said resilient latch body at one end thereof.

11. The trimmer device of claim 10 wherein said shroud body includes a pair of pockets for receiving said latch leg segments.

* * * * *